US006375188B1

(12) United States Patent
Painter et al.

(10) Patent No.: US 6,375,188 B1
(45) Date of Patent: Apr. 23, 2002

(54) RAISE YOUR BET 21

(76) Inventors: Leslie I. Painter, 2109 Tosca St., Las Vegas, NV (US) 89128; Gilford Allen, 301 Alalon Cir., Las Vegas, NV (US) 89107; Ron Nadeau, 2204 Club Pacific Way, Las Vegas, NV (US) 89128

( * ) Notice: Subject to any disclaimer, the term of this patent is extended or adjusted under 35 U.S.C. 154(b) by 0 days.

(21) Appl. No.: 09/275,864

(22) Filed: Mar. 25, 1999

(51) Int. Cl.[7] ..... A63F 1/00
(52) U.S. Cl. ..... 273/292; 273/274
(58) Field of Search ..... 273/292, 274, 273/309

(56) References Cited

U.S. PATENT DOCUMENTS 5,275,415 A * 1/1994 Wisted ..... 273/274
5,397,128 A * 3/1995 Hesse et al. ..... 273/292
5,411,268 A * 5/1995 Nelson et al. ..... 273/292
5,413,353 A * 5/1995 Demarest et al. ..... 273/292
5,496,038 A * 3/1996 Kangsanaraks ..... 273/292
5,529,309 A * 6/1996 Bartlett ..... 273/292
5,566,946 A * 10/1996 Parker ..... 273/292
5,799,946 A * 9/1998 Groussman ..... 273/292
5,810,360 A * 9/1998 Srichayaporn ..... 273/292

* cited by examiner

*Primary Examiner*—Benjamin H. Layno
(74) *Attorney, Agent, or Firm*—Leonard Weiss

(57) ABSTRACT

A method of playing a blackjack games prior to cards being dealt, a player places cheques representative of a bet within a betting circle carried on a covering of a gaming table. Additionally, the player places cheques representative of a commission within a RAISE YOUR BET circle carried on the covering. The commission is collected by the dealer. Thereafter, a first card is dealt face-up to the player and a first card is dealt face-down to the dealer. The player is then given an option of increasing the bet. A second card is dealt face-up to the player and a second card is dealt face-up to the dealer. The game then proceeds in a manner of the game of blackjack in the prior art.

4 Claims, 1 Drawing Sheet

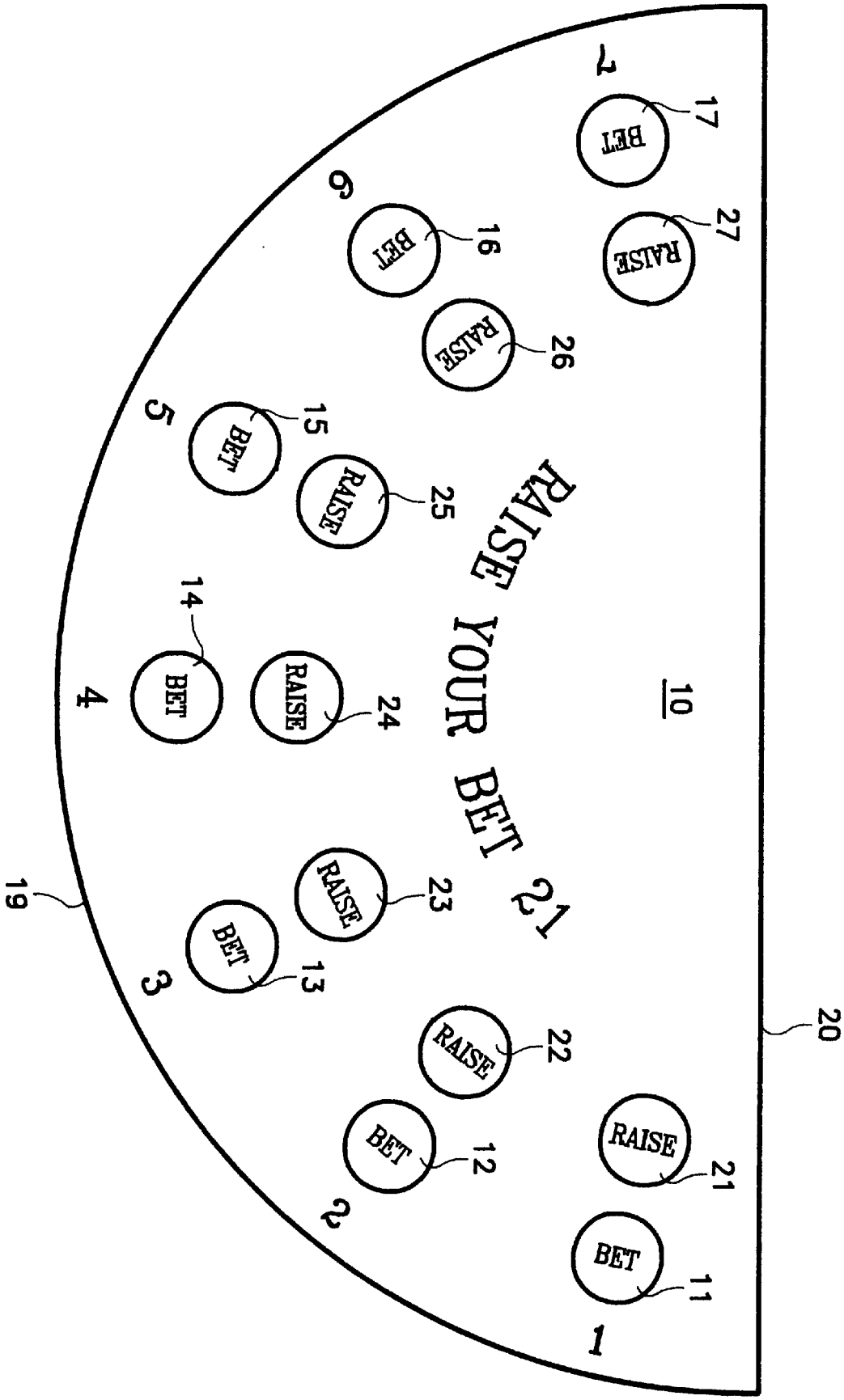
RAISE YOUR BET
10
20
21
19
1
2
3
4
5
6
7
BET
RAISE
11
12
13
14
15
16
17
21
22
23
24
25
26
27

RAISE YOUR BET 21

BACKGROUND OF THE INVENTION

1. Field of Invention

This invention is in the general field of casino gaming and, more particularly, relates to a card game known as 21.

2. Description of the Prior Art

In casinos throughout the world, the most widely played card game is 21, also known as Black Jack. The game is played with six to eight standard decks of cards that are shuffled together and dealt from a shoe by a dealer. Each card has a point value. An ace has a point value of either 1 or 11. Kings, queens and jacks have a point value of 10. All other cards have a point value equal to their nominal value.

The cards are dealt upon a green felt covering of a semi-circular table top. Images of seven player stations are typically carried on the covering, evenly spaced along the table top's arcuate edge. A dealer is usually near the center of the table top's straight edge.

As many as seven players are each given exclusive access to a player station. Accordingly, each player is said to have a player station.

A player station includes an outline of a betting circle. Before any cards are dealt, each player makes a bet by placing cheques representative of the bet within the betting circle of their player station.

After the bets are made, a first card is dealt face-up to each player and to the dealer. A second card is then dealt face-up to each player and face-down to the dealer, whereby each player and the dealer has a hand comprised of two cards. The dealer's second card is usually referred to as a hole card.

A point value of a hand is the sum of the point values of cards comprising the hand. It should be understood that an object of the game is to acquire a hand whose point value is as close to 21 as possible, without exceeding 21. A player loses his/her bet by acquiring a hand with a point value that exceeds 21.

When the dealer's first card has a point value of 10 or is an ace, the dealer must look at the hole card. When the sum of the point values of the dealer's first card and hole card is 21 (referred to as a natural), the dealer announces the words, "Twenty-one" or "Black Jack". A player who has the natural makes a similar announcement.

When the dealer has the natural, players having naturals retrieve their bets. The dealer collects the bets of players that do not have the natural.

When the dealer does not have the natural, each player that has the natural usually receives a 3 to 2 payout on their bet. Additionally, each player having a hand with a point value of less than 21 may elect to have their hand augmented by one or more additional cards. Thereafter, a player who has a hand with a point value of 21 or less is referred to as a surviving player.

After the player's have made their election, the dealer exposes the hole card. When the dealer's hand has a point value of 16 or less, the dealer's hand must he augmented with additional cards until it has a point value greater than 16. When the dealer's hand has a point value greater than 21, the dealer is said to have busted and makes a one to one payout on the bet of each of the surviving players.

The dealer's hand may not be augmented when it has a point value greater than 16. In other words, when the dealer's hand has a point value in a range of 17 to 21, it is the dealer's final hand.

Each of the surviving players win a one to one payout on their bet when they have a hand with a point value greater than the point value of the dealer's final hand. Conversely, each of the surviving players lose their bet when they have a hand with a point value less than the point value of the dealer's final hand. Surviving players retrieve their bets when their hand has a point value equal to the point value of the dealer's final hand.

A frequent experience of a 21 player is a desire to increase their bet when their first card either has a point value of ten or is an ace. However, 21 players are not permitted to view their first card and then decide whether to increase their bet. Heretofore, an unattractive feature of the usual game of 21 is an inflexibility of betting rules.

SUMMARY OF THE INVENTION

An object of the present invention is to provide a variation of the game of 21 where there is an increased flexibility of betting rules.

According to the present invention, in a variation of 21 called RAISE YOUR BET 21, a player makes a bet and pays a RAISE YOUR BET surcharge to a dealer before cards are dealt. After the player is dealt one card, the player has an option of increasing the bet.

The invention provides a flexibility of betting in 21 that is heretofore unknown.

Other objects, features, and advantages of the invention should be apparent from the following description of the preferred embodiment thereof as illustrated in the accompanying drawing.

BRIEF DESCRIPTION OF THE DRAWING

The sole FIGURE herein is a simplified plan view of a covering of a table top where bets are placed and cards are dealt in accordance with the preferred embodiment.

DESCRIPTION OF THE PREFERRED EMBODIMENT

As shown in the drawing, a gaming table, of a type used in a casino, has a semi-circular table top 10 with a green felt covering that carries betting circles 11–17 thereon, each with the word, BET, lettered therein. The circles 11–17 are evenly spaced along an arc (not shown) that is parallel to an arcuate edge 19 of the table top 10. The circles 11–17 are proximal to the edge 19. A dealer employed by the casino is usually near the center of a straight edge 20 of the table top 10.

The green felt covering additionally carries RAISE YOUR BET circles 21–27 thereon, each with the word, RAISE, lettered therein. The circles 21–27 are evenly spaced along an arc that is parallel to the edge 19. The edge 19 and an arc defined by the circles 215 27 bracket the circles 11–17 therebetween. Moreover, the circles 11, 21, the circles 12, 22, the circles 13, 23, the circles 14, 24, the circles 15, 25, the circles 16, 26 and the circles 17, 27 are pairs that are substantially radially disposed from the center of the edge 19.

The circles 11, 21 form a player station number 1 as indicated by lettering of the numeral, 1, proximal to the circle 11. A player may be seated near the edge 20 for access to the player station number 1. It should be understood that the player has exclusive access to the station number 1. In a similar manner, the circles 12–17 and the circles 22–27, respectively, form player stations 2–7.

At the start of play, the player at station number 1 places cheques representative of an initial bet within the circle 11 and cheques representative of a RAISE YOUR BET commission within the circle 21. In a similar manner, cheques representative of initial bets are placed within the circles 22–27 and cheques representative of RAISE YOUR BET commissions are placed within the circles 12–17 by other players.

The commission is preferably on the order of five percent of the initial bet. The amount of the commission and a minimum initial bet is set by the casino. The commission is collected by the dealer.

After the bets are made and the commissions collected, one card is dealt face-up to each player and face-down to the dealer. The players are then each in turn given an option of increasing their bet preferably up to a maximum five times their initial bet. Thereafter, a second card is dealt face-up to each of the players and a second card is dealt face-down to the dealer. The game then proceeds in a manner of the game of 21 of the prior art.

While the invention has been particularly shown and described with reference to a preferred embodiment thereof, it should be understood by those skilled in the art that changes in form and detail may be made therein without departing from the spirit and scope of the invention.

We claim:

1. In the method of playing a blackjack game in a casino, comprising the steps of:

a player paying a commission to a dealer working for the casino, prior to cards being dealt;

said player making an initial bet separate from said commission prior to cards being dealt;

prior to any cards being dealt, said dealer collecting said commission;

said dealer dealing one card to said player to form a player hand;

said dealer dealing one card face-down to said dealer to form a dealers hand; and giving said player an option of raising said bet after said player's one card is dealt, said game proceeding in a manner of the game of blackjack, wherein said player's final hand is compared to said dealer's final hand, after said player is given said option.

2. In the method of claim 1 wherein said card dealt to said player is dealt face-up.

3. In the method of claim 1 wherein said commission is on the order of five percent of said initial bet.

4. In the method of claim 1 wherein said player is given said option of raising said initial bet by an amount up to five times said initial bet after said one card is dealt to said player and said one card is dealt to said dealer.

* * * * *